United States Patent [19]

Tamura

[11] Patent Number: 4,952,923

[45] Date of Patent: Aug. 28, 1990

[54] DISPLAY APPARATUS WITH IMAGE EXPANDING CAPABILITY

[75] Inventor: Yoh Tamura, Kanagawa, Japan

[73] Assignee: Mitsubishi Denki K.K., Tokyo, Japan

[21] Appl. No.: 191,246

[22] Filed: May 6, 1988

[30] Foreign Application Priority Data

May 11, 1987 [JP] Japan ..... 62-113757

[51] Int. Cl.[5] ..... G09G 5/00

[52] U.S. Cl. ..... 340/731; 340/812; 358/77; 358/451

[58] Field of Search ..... 340/812, 720, 731, 723; 358/22, 77, 160, 180, 287, 451, 452

[56] References Cited

U.S. PATENT DOCUMENTS

| | | | |
|---|---|---|---|
| 3,935,381 | 1/1976 | Petrocelli et al. | 358/180 |
| 4,087,808 | 5/1978 | Herndon, Jr. | 340/731 |
| 4,153,896 | 5/1979 | White | 340/731 |
| 4,275,450 | 6/1981 | Potter | 358/77 |
| 4,356,482 | 10/1982 | Oguchi | 340/731 |
| 4,479,119 | 10/1984 | Sakano | 340/731 |
| 4,503,469 | 3/1985 | Kato | 358/77 |
| 4,532,602 | 7/1985 | DuVall | 340/731 |
| 4,644,339 | 2/1987 | Ruder | 340/731 |
| 4,672,369 | 6/1987 | Preiss et al. | 340/731 |
| 4,686,580 | 8/1987 | Kato et al. | 358/77 |
| 4,757,311 | 7/1988 | Nakamura et al. | 340/731 |

FOREIGN PATENT DOCUMENTS

| | | |
|---|---|---|
| 57-37059 | 8/1982 | Japan . |
| 58-28585 | 6/1983 | Japan . |
| 58-52231 | 11/1983 | Japan . |

*Primary Examiner*—Alvin Oberley
*Assistant Examiner*—Richard Hjerpe
*Attorney, Agent, or Firm*—Kanesaka & Takeuchi

[57] ABSTRACT

According to the prior art, the image data expanded in the image memory is read out for display of an expanded picture image so that not only an additional memory capacity has been required for the expanded display but also it takes a considerable time to expand. According to the invention, there is provided a control device for output a horizontal synchronizing signal once in a number of cycles. In response to this modified horizontal synchronizing signal, image data is read out of the image memory and allotted to a number of pixel positions for expanded display.

7 Claims, 4 Drawing Sheets

DISPLAY APPARATUS WITH IMAGE EXPANDING CAPABILITY

BACKGROUND OF THE INVENTION

This invention relates to an image display apparatus for displaying an expanded image by scanning the screen according to the image data read out of the memory.

An image display apparatus for displaying picture images by scanning the screen is synchronized with a vertical synchronizing signal for synchronizing fields, a horizontal synchronizing signal for synchronizing scanning lines, and a pixel synchronizing signal to output a succession of frames on the screen.

FIG. 6 shows a conventional image display apparatus by such synchronized scanning, which includes a memory 1 for storing image data, a memory control section 2 for controlling the memory 1, a processor 3 for generating the image data to be stored in the memory 1, a magnifying section 4 for expanding the image data from the processor 3 and feeding the expanded image data to the memory 1, a shift register for breaking down the image data from the memory 1 into picture elements (pixels), an oscillator 6 for generating the same frequency as the pixel frequency of a display, a vertical address counter 7 responsive to a horizontal synchronizing signal to count the number of scanning lines, and a horizontal address counter 8 responsive to a pixel synchronizing signal to count the number of pixel positions.

In operation, the processor 3 feeds the magnifying section 4 with the picture image data to be displayed. The magnifying section 4 feeds the memory 1 with the magnified or expanded image data and the memory control section 2 with a write request signal. In response to this write request signal, the memory control section 2 writes the image data on the memory 1.

The image data written in the memory 1 is displayed as follows. When a vertical synchronizing signal indicative of the start of a field is applied to the vertical address counter 7 via an input terminal 9, the vertical address counter 7 is initialized to a value equal to (the first vertical address−1). A horizontal synchronizing signal for synchronizing the scanning line to be displayed is applied to both the vertical address counter 7 and the horizontal address counter 8 via an input terminal 10. In response to this horizontal synchronizing signal, the vertical address counter 7 is incremented by one address while the horizontal address counter 8 is initialized to the first horizontal address. The vertical and horizontal memory addresses thus initialized are applied to the memory control section 2. The memory control section 2 feeds these addresses to the memory 1 to read out the contents from the memory 1 and feed them to the shift register 5. The shift register 5 breaks down the readout data into pixels with a clock signal generated by the oscillator 6 so as to have a frequency equal to the display frequency and presents the pixels at an output terminal 11. When the shift register 5 outputs all the pixels, the horizontal address counter 8 is incremented in response to a clock signal of the oscillator 6 so that the next memory address is applied to the memory control section 2. In this way, the display operation continues.

FIG. 7(*a*) shows a relationship between the horizontal synchronizing signal and the clock signal when no expanding operation is performed in the magnifying section 4, while FIG. 7(*b*) shows a similar relationship when the image data is expanded both vertically and horizontally with a magnification of 2 in the magnifying section 4 before the display data is written in the memory 1.

With such a conventional image display apparatus as described above, however, the picture image must be expanded before storage of the image memory, thus requiring an additional time for the display process. In addition, a complicated magnifying device is required.

SUMMARY OF THE INVENTION

Accordingly, it is an object of the invention to provide an image display apparatus having a constant number of bits of data to be written in the image memory regardless of the size of an expanded image display, thereby saving the memory capacity.

Another object of the invention is to provide an image display apparatus capable of processing expanded images in short times, thus providing high speed expanded image display capability.

Still another object of the invention is to provide an image display apparatus capable of providing an expanded image display without the use of a complicated magnifying device.

According to the invention there is provided an image display apparatus in which the stored data is read out of the memory in response to an expanded horizontal synchronizing signal output from a control device for authorizing output of the horizontal synchronizing signal once in a number of cycles and allotted to a plurality of pixel positions, thus providing an expanded picture image.

Other objects, features, and advantages of the invention will be apparent from the following description taken in conjunction with the accompanying drawings.

DESCRIPTION OF THE PREFERRED EMBODIMENT

Figure 1:
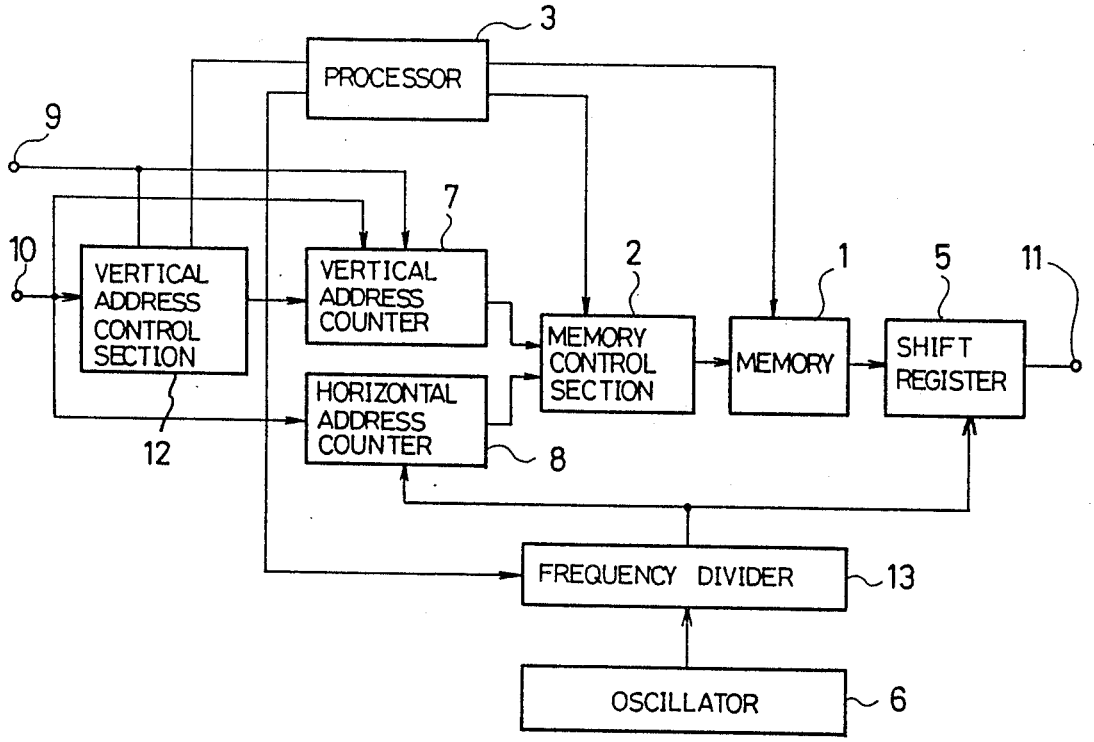
FIG. 1 is a block diagram of an image display apparatus according to an embodiment of the invention.
Figure 6:
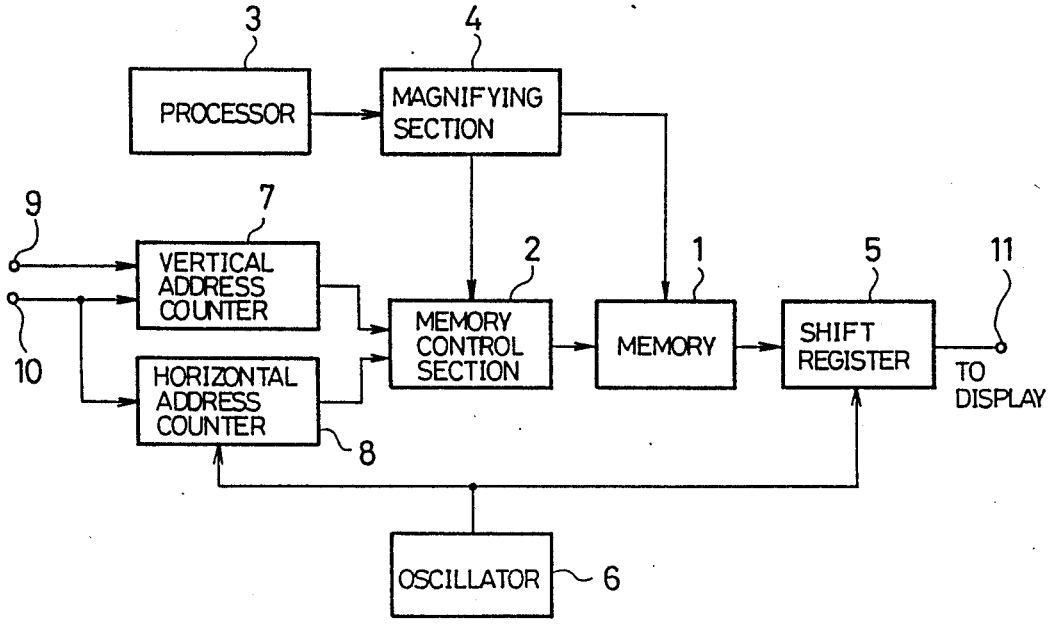
FIG.6 PRIOR ART
FIG. 6 is a block diagram of a conventional image display apparatus.

FIG. 1 shows an image display apparatus according to an embodiment of the invention, in which like reference numerals denote like members in FIG. 6, and their description will be omitted. This image display apparatus further includes a vertical address control section 12 responsive to an instruction of the processor 3 to feed a vertical synchronizing signal once in a plurality of cycles to the vertical address counter and a frequency divider 13 responsive to an instruction of the processor 3 to divide the frequency of a clock signal from the oscillator 6.

In operation, the processor 3 feeds the image data to be displayed to the memory 1 and a write request signal for the memory 1 to the memory control section 2. In response to the write request signal from the processor 3, the memory control section 2 writes the image data in the memory 1.

The image data written in the memory 1 is displayed as follows. Before displaying operation, the processor 3 feeds a magnifying power signal both to the vertical address control section 12 and the frequency divider 13. In response to the magnifying power signal from the processor 3, the frequency divider 13 reduces the frequency of a clock signal from the oscillator 6 to a frequency of 1/magnifying power (or magnification) and feeds it to the shift register 5 and the horizontal address counter 8.

When a vertical synchronizing signal indicative of the start of a field is applied to the vertical address counter 7 and the vertical address control section 12 via the input terminal 9, the vertical address counter 7 is initialized to a value equal to (the first vertical memory address−1) while the vertical address control section 12 feeds a vertical address change authorization signal to the vertical address counter 7. A horizontal synchronizing signal for synchronizing scanning lines is applied to the vertical address counter 7, the horizontal address counter 8, and the vertical address control section 12 via the input terminal 10. In response to both the horizontal synchronizing signal and the vertical address change authorization signal, the vertical address counter 7 is incremented by one address. In response to the horizontal synchronizing signal, the horizontal address counter 8 is initialized to the first horizontal memory address. Unless the magnifying power is one, the vertical address control section 12 stops feeding the vertical address change authorization signal to the vertical address counter 7 when the horizontal synchronizing signal changes from a valid state to an invalid state.

The vertical and horizontal memory addresses thus initialized are applied to the memory control section 2. The memory control section 2 feeds these addresses to the memory 1 to read out and feed the contents to the shift register 5. In response to a clock signal of a frequency equal to (1/magnification) the frequency of a pixel clock signal for the display, the shift register 5 breaks down the readout data and presents at the output terminal 11 a pixel signal which has been expanded in the horizontal direction. When the shift register 5 outputs all the pixels, in response to the (1/magnification) clock signal from the frequency divider 13, the horizontal address counter 8 is incremented to provide the memory control section 2 with the next memory address.

The vertical address control section 12 counts the number of transitions from a valid state to an invalid state of the horizontal synchronizing signal. When the counted number is in agreement with that of the magnifying power from the processor 3, the vertical address control section 12 feeds a vertical address change authorization signal to the vertical address counter 7. When the horizontal synchronizing signal changes from a valid state to an invalid state during this vertical address change authorization period, the vertical address control section 12 stops feeding the vertical address change authorization signal. Consequently, the vertical address counter 7 is incremented by one whenever n horizontal synchronizing pulses are fed wherein n is the magnifying power. Thus, the same image data is read out for n scanning lines for display expanded in the vertical direction. The vertical address control section and the frequency divider will be described in more detail.

Figure 2:
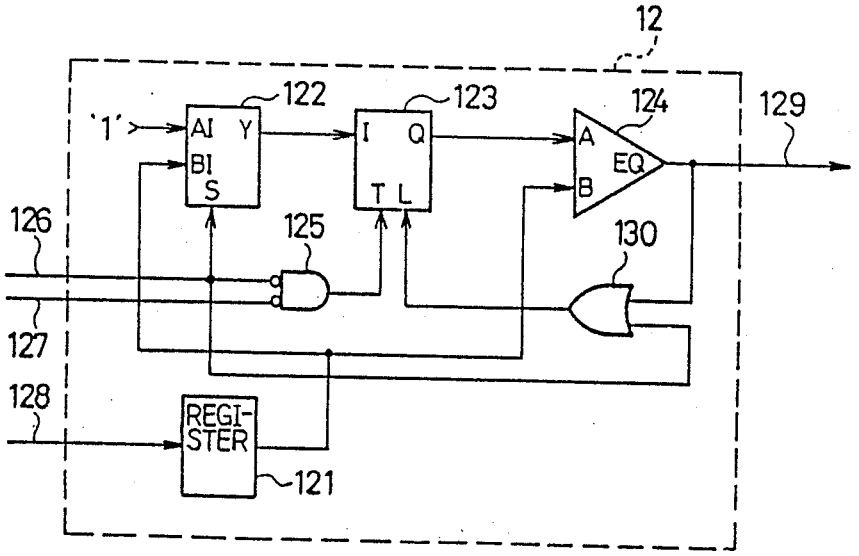
FIG. 2 is a schematic diagram of a vertical address control section useful for the apparatus of FIG. 1 according to an embodiment of the invention.

FIG. 2 shows a vertical address control section 12 according to an embodiment of the invention, which includes a signal line 126 for the vertical synchronizing signal, a signal line 127 for the horizontal synchronizing signal, a signal line 128 for transmitting a magnifying power signal from the processor 3, a signal line 129 for outputting a vertical address change authorization signal, a register 121 for storing the magnifying power signal, and a selector 122 having an input terminal AI into which a number 1 is input, an input terminal BI into which the contents of the register 121 are input, an output Y, and a select terminal S into which a vertical synchronizing signal is input. In response to a logic state of the vertical synchronizing signal input to the select terminal S, the selector 122 selectively presents at the output terminal Y the contents of input terminal either AI or BI. In this embodiment, when a valid state (logic "1") of the vertical synchronizing signal is applied to the select input terminal S, the selector 122 selects the contents at the input terminal BI while, in the case of an invalid state (logic "0"), the selector 122 selects the contents of the input terminal AI.

A counter 123 connected to the output terminal Y of the selector 122 has an input terminal I into which an initial value is fed, a clock signal input terminal T, an initialization request input terminal L, and a count output terminal Q. When the input signal to the clock signal input terminal T changes from "0" to "1" while the input to the initialization request input terminal L is "0", the counter 123 adds "1" to the stored number and output it at the count output terminal Q. In contrast, when the input signal to the clock signal input terminal T changes from "0" to "1" while the input to the initialization request input terminal L is "1", the counter 123 presents at the count output terminal Q the number which has been fed to the input terminal I.

A comparator 124 has an input terminal A into which the contents to be stored are input, an input terminal B into which the magnifying power stored in the register 121 is input, and an output terminal EQ. The output terminal EQ may take either "0" or "1"; when the data input to the input terminal AI is in agreement with the data input to the input terminal BI, it takes "1". The comparator 124 presents at the output terminal EQ a vertical address change authorization signal, which is applied to the vertical address counter 7 via the signal line 129.

A AND circuit 125 inverts both inputs at the signal lines 126 and 127 and feeds a logical product signal to the clock input T of the counter 123. A two-input OR circuit 130 receives the EQ output from the comparator 124 and the vertical synchronizing signal via the signal line 126 and feeds a logical sum signal to the counter 123.

In operation, a magnifying power signal from the processor 3 is stored in the register 121 via a signal line 128. At this point, the respective vertical and horizontal synchronizing signals of the signal lines 126 and 127 are "0" (invalid state).

When the vertical synchronizing signal of the signal line 126 is changed to "1" (valid state), the select terminal S of the selector 122 is changed to "1" thus presenting the magnifying power stored in the register 121 at the output terminal Y via the input terminal BI of the selector 122. Consequently, the inputs and output of the AND circuit 125 become "1" and "0", and "0", respectively, while the inputs and output of the OR circuit 130 become "0" and "1", and "1", respectively.

When the vertical synchronizing signal of the signal line 126 changes from "1" to "0", the output of the AND circuit 125 changes from "0" to "1", which is applied to the clock input T of the counter 123. Thus, the counter 123 stores the magnifying power present at the input terminal I and presents it at the output terminal Q.

When the vertical synchronizing signal of the signal line 126 becomes "0", the select terminal S of the selector 122 becomes "0", presenting at the output terminal Y the value "1" present at the input terminal. The comparator 124 receives at the input terminal A the magnifying power stored in the counter 123 and at the input terminal B the magnifying power stored in the register 121 and presents "1" at the output terminal EQ, thus authorizing vertical address change. One of the inputs of the OR circuit 130 becomes "1" thus feeding "1" to the initialization request terminal L of the counter 123.

When the horizontal signal of the signal line 127 is changed to "1", the output of the AND circuit 125 becomes "0". When the horizontal synchronizing signal changes from "1" to "0", the output of the AND circuit 125 is changed to "1", changing the input to the input terminal T of the counter 123 from "0" to "1" so that the counter 123 stores the value "1" present at the input terminal I and presents it at the output terminal Q. This brings the two values present at the input terminals A and B of the comparator 124 into disagreement with each other, presenting "0" at the output terminal EQ, thus inhibiting any change in the vertical address. Both the input of the OR circuit 130 become "0", thus feeding "0" to the initialization request input terminal L of the counter 123.

Every time the horizontal synchronizing signal of the signal line 127 is changed from "1" to "0", the counter 123 adds 1 to the contents. When the stored contents reach the value of the magnifying power, they become "1" by the operation described above. With repetition of such operations, a vertical address change authorization signal is output once in a plurality of cycles as specified by the magnifying power.

Figure 3:
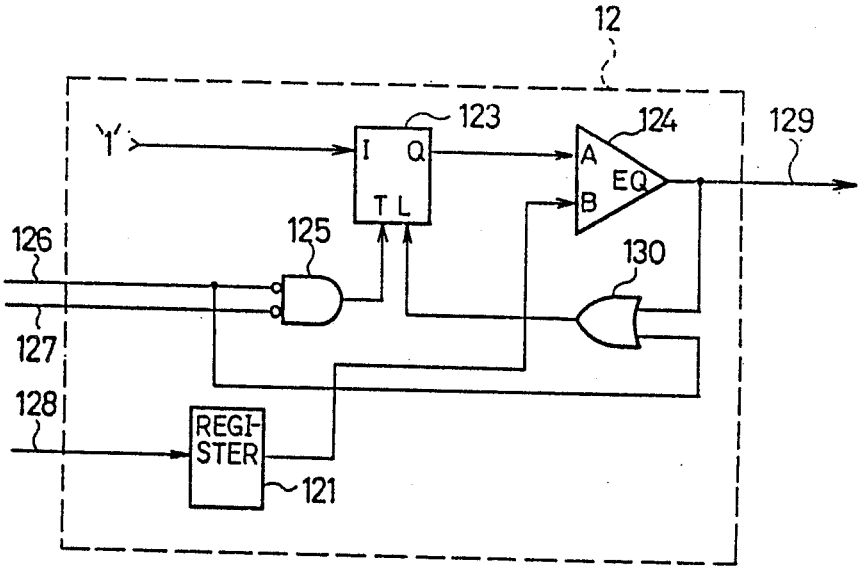
FIG. 3 is a schematic diagram of a vertical address control section useful for the apparatus of FIG. 1 according to another embodiment of the invention.

FIG. 3 shows a vertical address control section according to another embodiment of the invention, wherein the selector 122 of FIG. 2 is eliminated. When a vertical synchronizing signal is applied via the signal line 126, the initial value of the counter 123 becomes 1. Thus, when the magnifying power applied to the register 121 is not 1, no vertical address change authorization signal is output at the signal line 129 upon application of the first horizontal synchronizing signal. Consequently, until the first vertical address change authorization signal is output, the vertical address counter 7 remains at a value of (the first vertical memory address − 1), thus providing a wrong display. However, this may be corrected by restricting the scope of display or storing a non-display code as the first part of the memory contents.

Figure 4:
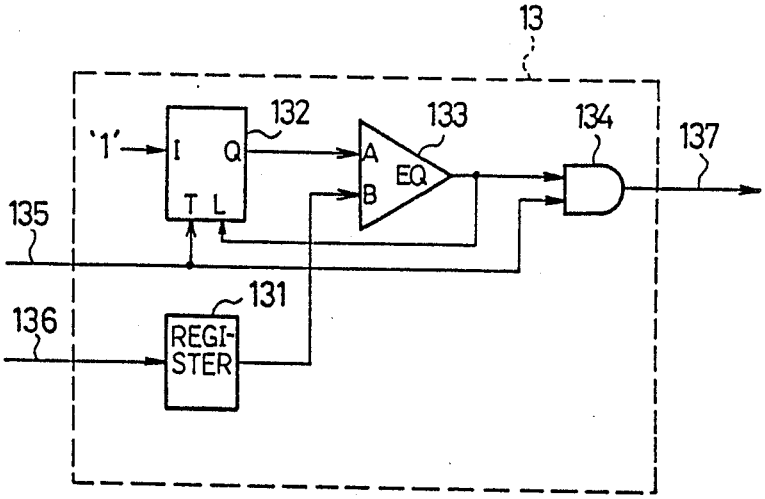
FIG. 4 is a schematic diagram of a frequency divider useful for the apparatus of FIG. 1.

FIG. 4 shows an embodiment of the frequency divider 13, which includes a signal line 135 for transmitting a clock signal of the oscillator 6, a signal line 136 for transmitting a magnifying power from the processor 3, and a signal line 137 for outputting a (1/magnification) clock signal. It also includes a register 131 for storing the magnifying power, a counter 132, and a comparator 133, all of which are identical with the register 121, counter 122, and comparator 123, respectively, of FIG. 2.

The counter 132 receives at the input terminal I a value 1, at the clock input terminal T a clock signal via the signal line 135, and at the initialization request terminal L an EQ output of the comparator 133. The comparator 133 receives at the input terminal A the contents stored in the counter 132 and at the input terminal B the contents stored in the register 131 and presents "1" at the output terminal when both values input at the input terminals A and B are equal. The two-input AND circuit 134 receives at the two input terminals an EQ output of the comparator 133 and a clock signal of the signal line 135 and presents a (1/magnification) clock signal at the signal line 137.

In operation, the magnifying power signal from the processor 3 is stored in the register 131 via the signal line 136. When the contents of the counter 132 are in agreement with the magnifying power stored in the register 131, the comparator 133 presents "1" at the output terminal EQ. Thus, the AND circuit 134 presents at the signal line 137 a clock signal having a frequency equal to (1/magnification) the frequency of the clock signal at the signal line 135. Meanwhile, the initialization request input terminal L of the counter 132 receives "1".

When a clock signal is applied to the terminal T via the signal line 135, the counter 132 stores the value 1 present at the input terminal I and presents it at the output terminal Q. This brings the contents present at the two input terminals of the comparator 133 into disagreement with each other, thus presenting "0" at the output terminal EQ. Thus, the output of the AND circuit 134 is always "0". Meanwhile, the counter 132 receives "0" at the initialization request input terminal L.

Every time a clock signal is input via the signal line 135, the counter 132 adds 1 to the contents stored. With repetition of the above operation, the clock signal input via the signal line 135 is output at the signal line 137 once in a plurality of cycles as specified the magnifying power stored in the register 131. The image data thus expanded is shown in FIG. 5.

Figure 5:
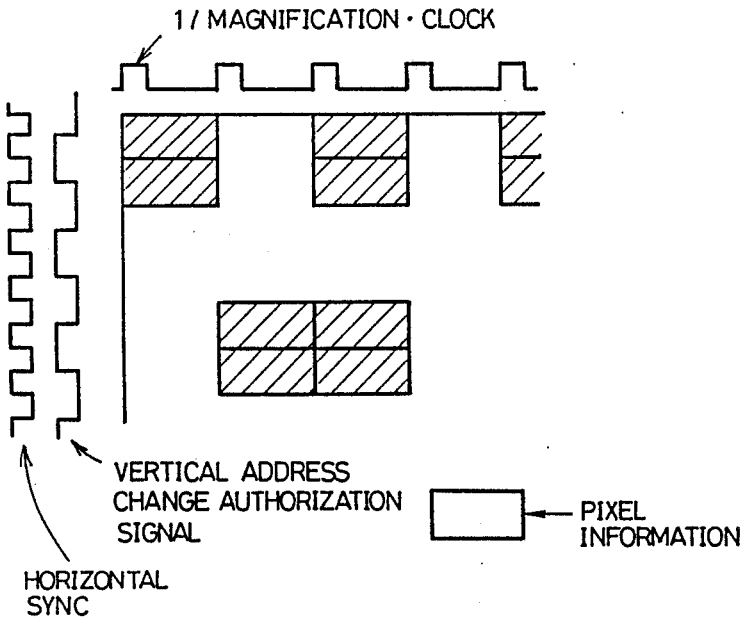
FIG. 5 shows an expanded picture image according to the invention.
Figure 7:
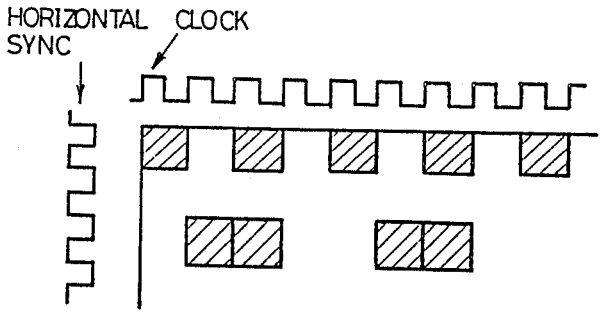
FIG. 7 A (PRIOR ART)
FIGS. 7(*a*) and 7(*b*) show a ordinary picture image and an expanded picture image, respectively, according to the prior art.
Figure 7:
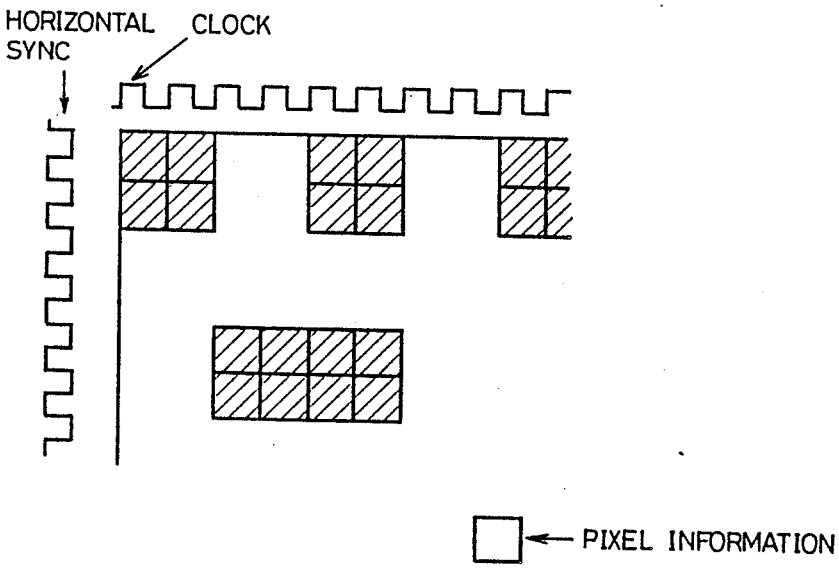
FIG. 7 B (PRIOR ART)

FIG. 5 shows the image data in scanning lines at a magnification of 2 in both the horizontal and the vertical directions with respect to the (1/magnification)-frequency clock, horizontal synchronizing signal, and vertical address change authorization signal. With this expanded image data, the same picture image as in FIG. 7 may be obtained with less picture information than that required by the prior art, thus providing an image display with high efficiency. In this way, by providing a control device for changing the frequency of a pixel synchronizing signal and a control device for authorizing an output of the horizontal synchronizing signal once in a plurality of cycles to allot the image data read out of the memory to a plurality of pixel positions, thus providing an expanded picture image. Since no expanded picture image is required to store in the image memory, the efficiency of the image memory is enhanced for displaying expanded picture images.

What is claimed is:

1. An image display apparatus of the type having a memory, a display, and a processor for sequentially feeding said display with image data read out of said memory in synchronism with a pixel synchronizing signal and scanning a screen of said display in synchronism with a horizontal and a vertical synchronizing signal to provide a picture image on said screen, wherein the improvement comprises:

variable means for changing a frequency of said pixel synchronizing signal according to an instruction of said processor;

address control means for storing a magnifying power signal from said processor and authorizing an output of said horizontal synchronizing signal once in a plurality of cycles; and means responsive to said authorized output to read out data from said memory and allotting said read-out data to a plurality of pixel positions, thereby providing an expanded picture image, wherein said address control means comprises:

a register for storing said magnifying power signal from said processor;

an AND circuit for said horizontal and vertical synchronizing signals;

a counter for counting the number of transitions in an output of said AND circuit;

a comparator for comparing an output of said counter with an output of said register to generate a comparison signal; and an OR circuit for making a logical sum of said comparison signal and said vertical synchronizing signal to reset said counter so that said comparison signal is authorized to output once in a plurality of cycles of said horizontal synchronizing signal.

2. The image display apparatus of claim 1, wherein said counter performs counting by detecting a falling transition of said output from said AND circuit.

3. The image display apparatus of claim 1, wherein said counter performs counting by detecting a rising transition of said output from said AND circuit.

4. An image display apparatus of the type having a memory, a display, and a processor for sequentially feeding said display with image data read out of said memory in synchronism with a pixel synchronizing signal and scanning a screen of said display in synchronism with a horizontal and a vertical synchronizing signal to provide a picture image on said screen, wherein the improvement comprises:

variable means for changing a frequency of said pixel synchronizing signal according to an instruction of said processor;

address control means for storing a magnifying power signal from said processor and authorizing an output of said horizontal synchronizing signal once in a plurality of cycles; and means responsive to said authorized output to read out data from said memory and allotting said read-out data to a plurality of pixel positions, thereby providing an expanded picture image, wherein said address control means comprises:

a register for storing said magnifying power signal from said processor;

an AND circuit for said horizontal and vertical synchronizing signals;

a counter for counting the number of transitions in an output of said AND circuit;

a comparator for comparing an output of said counter with an output of said register to generate a comparison signal;

an OR circuit for making a logical sum of said comparison signal and said vertical synchronizing signal to reset said counter; and a selector responsive to said vertical synchronizing signal to select either said output of said register or a predetermined value preset and feeds it to said counter as an initial value so that said comparison signal is authorized for output once in a plurality of cycles of said horizontal synchronizing signal.

5. The image display apparatus of claim 4, wherein said counter performs counting by detecting a falling transition of said output from said AND circuit.

6. The image display apparatus of claim 4, wherein said counter performs counting by detecting a rising transition of said output from said AND circuit.

7. An image display apparatus of the type having a memory, a display, and a processor for sequentially feeding said display with image data read out of said memory in synchronism with a pixel synchronizing signal and scanning a screen of said display in synchronism with a horizontal and a vertical synchronizing signal to provide a picture image on said screen, wherein the improvement comprises:

variable means for changing a frequency of said pixel synchronizing signal according to an instruction of said processor;

address control means for storing said horizontal synchronizing signal, said vertical synchronizing signal, and a magnifying power signal from said processor and authorizing an output of said horizontal synchronizing signal once in a plurality of cycles;

means responsive to said authorized output to read out data from said memory and allotting said read-out data to a plurality of pixel positions, thereby providing an expanded picture image, wherein said variable means comprises:

a second register for storing said magnifying power signal from said processor;

a second counter having an initial value input terminal into which an initial value is applied, a clock input terminal into which said pixel synchronizing signal is applied, and an initialization request input terminal for counting said pixel synchronizing signal;

a comparator for comparing an output of said counter with an output of said register to generate a comparison signal, which is fed back to said initialization request input terminal; and an AND circuit for receiving an output of said comparator and said pixel synchronizing signal and outputting a basic clock signal of a frequency which is lower than that of said pixel synchronizing signal.

* * * * *